US005987087A

United States Patent [19]

Zhuikov et al.

[11] Patent Number: 5,987,087

[45] Date of Patent: Nov. 16, 1999

[54] PROCESS FOR THE PRODUCTION OF RADIOISOTOPES OF SELENIUM

[75] Inventors: Boris L. Zhuikov; Vladimir M. Kokhanyuk, both of Moscow Region, Russian Federation

[73] Assignee: TCI Incorporated, Albuquerque, N.Mex.

[21] Appl. No.: 09/106,036

[22] Filed: Jun. 26, 1998

[51] Int. Cl.[6] ..... G21G 1/10

[52] U.S. Cl. ..... 376/195; 376/192; 376/190

[58] Field of Search ..... 376/195, 192, 376/201, 198, 190

[56] References Cited

U.S. PATENT DOCUMENTS

| | | | |
|---|---|---|---|
| 5,204,072 | 4/1993 | Phillips | 423/2 |
| 5,371,372 | 12/1994 | Phillips | 250/432 PD |
| 5,405,589 | 4/1995 | Phillips | 423/2 |

OTHER PUBLICATIONS

Appl. Radiat. Isot., vol. 39, No. 10, pp. 1085–1091, Mushtag et al., 1988.

Dennis R. Phillips, et al; "Electrolytic Separation . . . RbBr Targets"; 1987; pp. 521–525.

Regin Weinreich et al; "Production of . . . Energy Protons"; Jan. 1989; pp. 146–147.

*Primary Examiner*—Harvey E. Behrend

*Attorney, Agent, or Firm*—Robert W. Becker & Associates

[57] ABSTRACT

A beam of accelerated charged particles irradiates an arsenide target, such as gallium arsenide or aluminum arsenide, to produce radioisotopes of selenium and other radionuclides. The irradiated target is placed in a niobium, tantalum, or graphite vessel and inserted into a tube. Metallic reagents consisting of an alloy of iron, nickel, and chromium (stainless steel) or metallic aluminum are mixed with the target material. The target is then heated to 1000–1100° C. The metallic reagents prevent arsenic sublimation, destroy the crystalline structure of arsenide target, and remove other impurities, such as zinc-65. The target is then heated a second time to about 1300° C. causing the selenium-72 to sublime and be deposited on a cooler wall of the tube or on a catcher foil surface. The deposited selenium-72 is recovered from the tube or foil.

25 Claims, 2 Drawing Sheets

PROCESS FOR THE PRODUCTION OF RADIOISOTOPES OF SELENIUM

BACKGROUND OF THE INVENTION

1. Field of the Invention

This invention is related to the field of nuclear chemistry and in particular to the production of radioisotopes of selenium.

2. Description of the Prior Art

The radioisotope selenium-72 can be used as a radiopharmaceutical agent to diagnose a number of diseases. For example, selenium-72 is used in making a selenium/arsenic-72 generator. This generator has an application in medicine to diagnose a number of diseases with the use of positron emission tomography (PET).

One method for the production of selenium-72 and arsenic-72 is described in U.S. Pat. Nos. 5,204,072, 5,371,372, and 5,405,589 of Dennis R. Phillips. These patents describe a process wherein selenium-72 and numerous other isotopes are produced when a rubidium bromide target is irradiated with 800 MeV energy protons. The resultant selenium isotopes are electrolytically separated from the target (see D. R. Phillips, "Electrolytic separation of selenium isotopes from proton irradiated RbBr targets," Appl. Radiat. Isot., Vol. 38, pp. 521–525, 1987) or separated by precipitation or co-precipitation of metallic selenium by hydrazine dihydrochloride. There are number of shortcoming of this selenium-72 production process, including a multi-step complex radiochemical recovery procedure, a low production yield of selenium-72, a high level of selenium-75 and other impurity radionuclides, and the necessity of using a high energy proton beam to irradiate the target.

Another selenium-72 production method uses arsenic (As) or $Cu_3As_2$ targets irradiated with 50 to 70 MeV protons. A multi-step procedure is again required to recover the selenium-72 (see R. Schwarzbach et al, "Production of Se-72 and Se-73 by medium energy protons," J. Labeled Compounds & Radiopharmaceuticals, Vol. 26, pp. 146–147, 1989). These targets have a low resistance to heat requiring irradiation by a low intensity beam. The process again requires a complex radiochemical procedure to recover the selenium-72 and results in a low yield.

SUMMARY OF THE INVENTION

The present invention uses high temperature stable arsenic-containing targets to produce selenium-72. The target is irradiated by a beam of protons in the energy range of 40 to 100 MeV. Selenium-72 is extracted through direct high-temperature sublimation in the presence of metallic reagents and high temperature chemical filters. The heating is carried out in an atmosphere of inert, purified gas. Metallic reagents of stainless steel or aluminum are added to prevent arsenic sublimation and to destroy the crystalline structure of the arsenide compound. A preheating period at 1000 to 1100° C. is used to remove impurities, particularly zinc-65. During this period various compounds of Ga and As are formed with the metallic reagents. The arsenic compounds thus formed are sufficiently stable that they do not sublime at higher temperatures. The target is then heated for a period in the range of 1200 to 1330° C. causing micro-quantities of selenium-72 to be sublimed. The sublimed selenium-72 is transported by the inert gas and deposited in the cold portion of the tube.

DESCRIPTION OF THE PREFERRED EMBODIMENT

A target of gallium arsenide (GaAs) or aluminum arsenide (AlAs) is bombarded by 40–100 MeV protons (heavier ions may be used) to create radioisotopes from the target materials by spallation reactions. These isotopes include zinc-65, arsenic-72 and selenium-72. Other stable arsenide-based targets may also be used. An important additional advantage of GaAs and AlAs targets is that germanium-68 may be produced as a byproduct from GaAs targets and sodium-22 from the AlAs targets.

The preferred embodiment uses a target of powdered GaAs (200 mesh) sealed in a niobium container and irradiated by a beam of 40–100 MeV protons. After irradiation, the container is opened and the powdered material is extracted. The target shell can also be fabricated from copper, graphite, stainless steel, aluminum, molybdenum, or tantalum. All have advantages and disadvantages, but niobium was found to be the most reliable target container material, and it does not react with GaAs at high temperatures.

Figure 1:
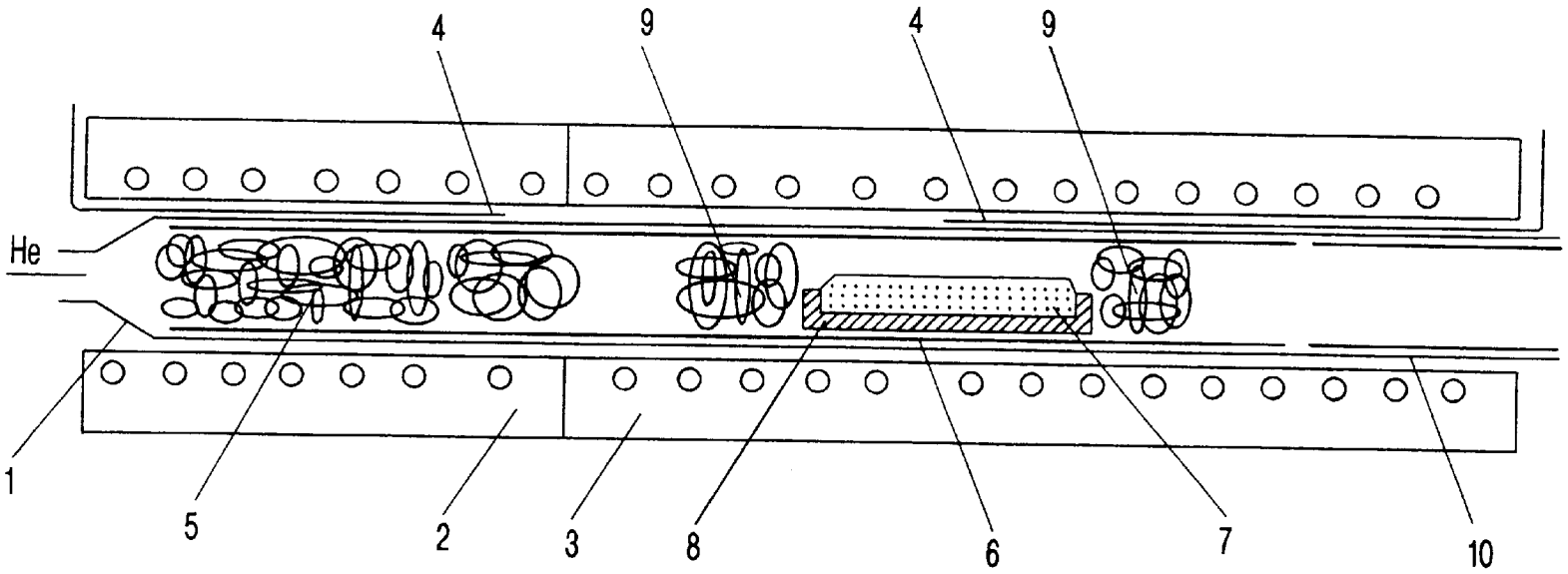
FIG. 1 illustrates the preferred apparatus for the recovery of selenium-72 from a GaAs target.

The experimental set up is shown in FIG. 1. Following irradiation, 300 mg of irradiated GaAs powder is mixed with 800 mg of stainless steel filings 7 and inserted into a tantalum vessel 8. The vessel could also be made of niobium or graphite. The vessel is covered with more filings and inserted into a quartz tube 1 coated on the inside with tantalum or niobium (in other experiments GaAs reacted with quartz, steel, and a number of other materials at high temperature). More stainless steel in the form of stainless steel chips 9 is inserted into the tube as a chemical filter for additional purification of selenium from arsenic at high tempertures.

A number of experiments, as well as thermodynamic calculations, have shown that such impurities as water, oxygen, etc., react with GaAs and cause the sublimation of arsenic.

To prevent this, an inert gas, e.g., highly purified helium, is blown through the tube. Prior to injection, the helium gas is first purified to remove water and any organic traces using a liquid nitrogen trap filled with charcoal. Subsequently, any oxygen, nitrogen, carbon monoxide, and carbon dioxide gases are removed using a getter 5 of metallic titanium or zirconium chips. A furnace 2 for the getter raises the titanium or zirconium chips to a temperature of 600 to 900° C. Zirconium is isolated from the quartz tube surface by niobium foil. A separate furnace for GaAs 3 is used to heat the target material. Thermocouples 4 are located between the tube and the heaters to monitor the heating process.

Figure 2:
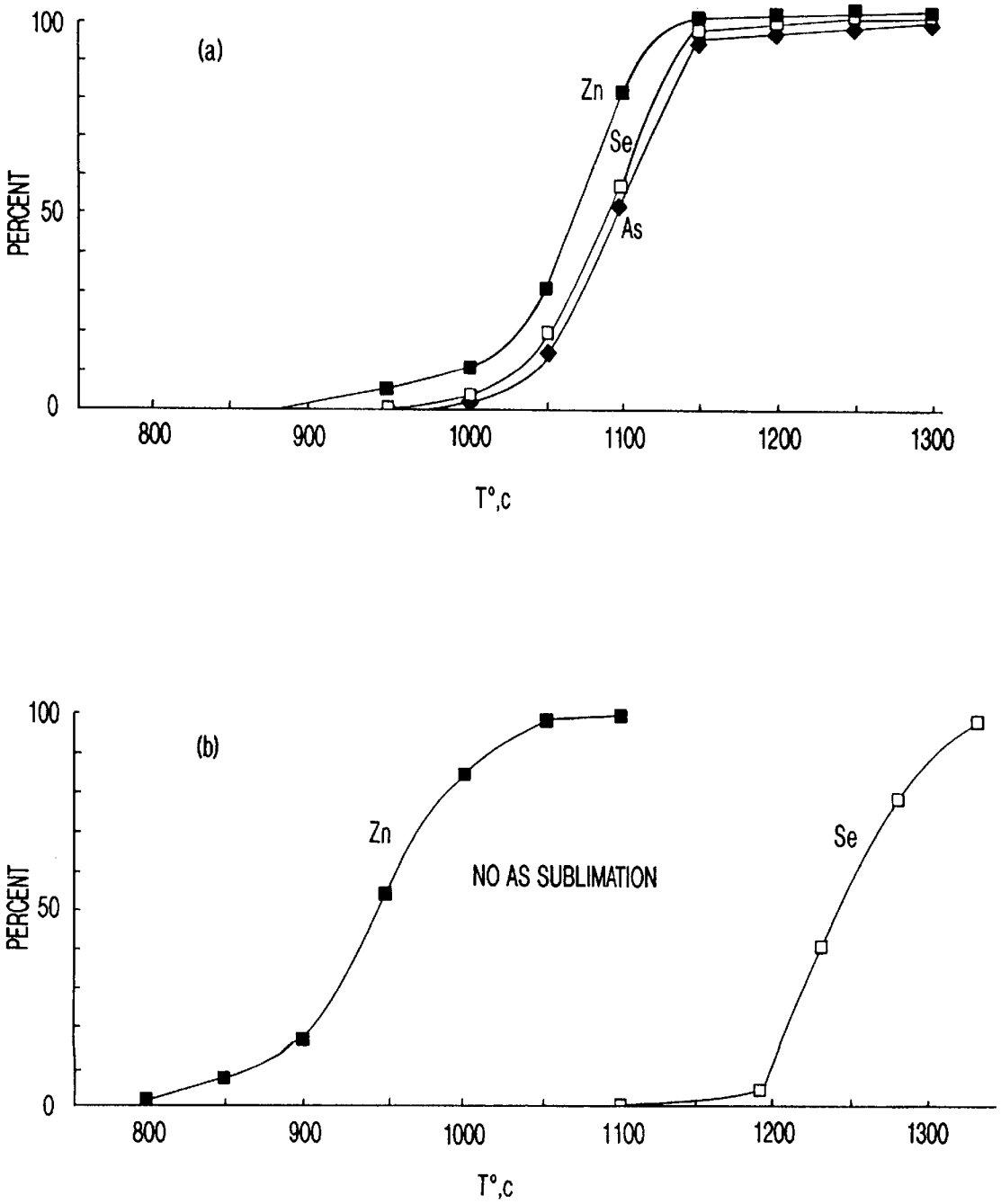
FIG. 2 is a plot of the sublimation temperature dependence of isotopes of selenium, zinc and arsenic in the absence (a) and presence (b) of stainless steel filings.

As it is shown in FIG. 2(*a*), radioisotopes of selenium are sublimed together with arsenic at high temperature in the absence of the metallic reagent (stainless steel). In the presence of stainless steel, however, no arsenic sublimation takes place (see FIG. 2(*b*)). The main components of the stainless steel used are: Fe-71%, Ni-10%, and Cr-18%.

During a 30-minute preheating period using the GaAs furnace 3 at a temperature range of 1000–1100° C., GaAs reacts with the steel components, destroys the crystalline structure of GaAs and forms a number of compounds with gallium and arsenic. The arsenic compounds thus formed are sufficiently stable so as not to sublime at higher temperatures. Zinc-65 impurities are always formed by the irradiation of GaAs with intermediate energy protons. Preliminary heating at 1000–1100° C. also removes the zinc-65. See the temperature dependence of zinc sublimation in FIG.2 (*b*). The steel reagents also have an important influence on zinc sublimation, as can be seen in a comparison of FIG. 2(*a*) and 2(*b*). Zinc-65, as well as certain other impurities, are deposited onto a separate "catcher" foil 10. This foil is located in the end of the tube where a temperature gradient exists, the temperature dropping from the 1000–1100° C. preheating range to about 300° C. This impurity-containing foil is removed from the tube before the higher temperature heating period (1200–1330° C.). During the higher temperature regime, selenium is deposited either on a different foil at this cool end of the tube or directly onto the quartz tube surface if no new foil is inserted.

Selenium-72 is sublimed at higher temperatures, however, since selenium in ultra micro quantities does not form high temperature stable compounds. The temperature dependence of selenium sublimation is shown in FIG.2 (*b*) where it only begins to sublime above 1100° C. A high temperature (1200–1330° C.) period following the preheating period causes the selenium-72 to completely sublime. This higher temperature period can range from 15 minutes to four hours, depending upon various parameters of the process, such as the depth of the powder layer and the gas flow rate. Sublimed selenium-72 is transported via the helium gas (gas flow 50 ml/min) to the cold end of the tube and deposited on the inside surface of the quartz tube or on the metallic foils lining the tube 10. In other experiments, purified argon or vacuum were used. Helium is the preferred gas, however. When vacuum is used instead of an inert gas, one side of the tube is closed and selenium is transported to the catcher in the cold part of the facility by free diffusion.

Practically no arsenic (less than 0.01%) is found in the selenium sublimate fraction using this process, yielding very pure selenium radioisotopes. In addition, the resulting boll of gallium alloy with steel components may be dissolved in acids to recover Ge-68.

In a second embodiment, 10 grams of GaAs powdered material is irradiated by protons (the best energy range is 45–60 MeV) in a closed stainless steel ampoule. A hole is made in the ampoule after the irradiation. The ampoule with the GaAs target is then heated up to 1100° C. in a tantalum vessel for four hours. The tantalum vessel is covered by quartz or ceramics to prevent the outer surface from oxidizing. The duration of this preheating period is long because of the large quantity of GaAs powder used. A temperature gradient dropping from 1000° C. to 300° C. is maintained at the gas outlet end of the tantalum vessel. Here a stainless steel catcher foil is inserted to absorb zinc-65 and some arsenic and organic impurities. The catcher foil is removed at the end of the four-hour preheating period. The target is next heated for four hours at 1300° C., causing selenium-72 to sublime. This selenium is deposited on the surface of a quartz tube inserted into the vessel in the temperature gradient region. The chemical yield of selenium-72 is more than 95%. The stainless steel target ampoule itself is used here as the reagent. Selenium-72 is removed from the quartz surface by 1N NaOH or 6N $HNO_3$ solutions.

Alternatively, there could be two gas outlets for the tantalum vessel, one containing the stainless steel catcher foil and the other the quartz tube. During the preheating period, the quartz tube outlet is closed and during the higher temperature period the catcher foil outlet is closed.

A third embodiment used two grams of AlAs powder irradiated by protons in a niobium shell. The powder was then mixed with two grams of aluminum foil chips and with five grams of graphite grains of about 1-mm in size. The mixture was placed inside a graphite tube and this tube inserted into a quartz tube. An additional chemical filter made of a mixture of aluminum chips and graphite grains was also put into the tube. All of the graphite had been heated in pure argon at 1100 to 1200° C. to remove organic substances prior to use. AlAs and the chemical filter were then heated in a 50 ml/min argon flow (purified with a zirconium getter) to 1200° C. Selenium-72 sublimes and deposits in the cold part of the tube with a yield of 95%. About 5% of the arsenic was captured in the aluminum/graphite filter but none in the fraction of selenium-72 sublimate. Eighty percent of the sodium-22 was also sublimed from the target and deposited separately at high (1000–1200° C.) temperature on the opened part of the quartz tube.

We claim:

1. A method of producing radioisotopes of selenium comprising the steps of:

a. irradiating an arsenide-based powder target in a sealed container with accelerated charged particles, whereby radioisotopes of selenium, arsenic, zinc, sodium, and other radionuclides are produced;

b. combining the irradiated arsenide target material with a metallic reagent;

c. inserting said combination into a tube capable of being heated such that a temperature gradient can be established;

d. maintaining a flow of purified inert gas through said tube;

e. heating said irradiated target to between 1200 and 1330° C. for a period sufficient to cause the selenium to be sublimed and deposited by the inert gas flow on the cooler downstream walls of the tube; and f. removing the selenium deposits from the walls of the tube by acid or alkaline solutions.

2. The method of claim 1, wherein said metallic reagent consist of an iron, nickel, and chromium containing alloy or of aluminum in filings form.

3. The method of claim 2, wherein said target material is removed from its sealed container and mixed with said metallic reagent in a niobium, tantalum, or graphite container.

4. The method of claim 3, wherein the mixture in its container is inserted into said tube along with stainless steel chips.

5. The method of claim 4, wherein said mixture in its container is preheated in a temperature range of 1000 to 1100° C. for a period sufficient to remove zinc-65 impurities.

6. The method of claim 5, wherein said mixture in its container is subsequently heated to between 1200 and 1330° C. for a period sufficient to cause the selenium to be sublimed and deposited by the inert gas flow on the cooler downstream walls of said tube.

7. The method of claim 6, wherein the arsenide target consists of gallium arsenide in powder form.

8. The method of claim 6, wherein the accelerated charged particles are 40 to 100 MeV protons.

9. The method of claim 6, wherein the metallic reagent is a stainless steel compound in filings form comprised of approximately 71% iron, 10% nickel, and 18% chromium.

10. The method of claim 6, wherein the arsenide target material is mixed with the metallic reagent in an approximate ratio of 3:8 by weight.

11. The method of claim 6, wherein the purified inert gas is helium and its flow rate is approximately 50 ml/min for an arsenide target weight of 300 mg.

12. The method of claim 6, wherein for step 1(*d*) a vacuum is maintained in said tube whereby selenium is deposited in the cooler end of said tube by free diffusion.

13. The method of claim 6, wherein the target material is irradiated by protons in the energy range of 40 to 100 MeV.

14. The method of claim 1, wherein a gallium arsenide (GaAs) target material is enclosed in a sealed stainless steel ampoule and irradiated.

15. The method of claim 14, wherein said ampoule after irradiation is unsealed, placed in a tantalum tube, and heated to 1100° C. for sufficient time to remove zinc-65 and other impurities via a stainless steel catcher foil placed in the cooler end of said tantalum tube.

16. The method of claim 15, wherein said catcher foil is removed and a quartz tube inserted into the cooler end of said tantalum tube.

17. The method of claim 16, wherein the purified GaAs target material is heated to a temperature of approximately 1300° C. sufficiently long to cause the selenium to sublime and be deposited on said quartz tube.

18. The method of claim 17, wherein the selenium deposits are removed from the walls of said quartz tube.

19. The method of claim 14, wherein the target material is irradiated by protons in the energy range of 45 to 60 MeV.

20. The method of claim 1, wherein the irradiated target consists of aluminum arsenide (AlAs) powder enclosed in a niobium shell.

21. The method of claim 20, wherein aluminum foil chips and graphite grains are mixed with said AlAs powder and the mixture inserted into a graphite tube, the aluminum foil chips and graphite grains serving as a chemical filter.

22. The method of claim 21, wherein said graphite tube is inserted into a quartz tube containing additional aluminum chips and graphite grains.

23. The method of claim 22, wherein said mixture is heated to approximately 1200° C. in the presence of a purified argon flow such that the sublimed selenium is deposited on the cooler parts of the quartz tube.

24. The method of claim 23, wherein the selenium deposits are removed from the walls of said quartz tube.

25. The method of claim 20, wherein the target material is irradiated by protons in the energy range of 40 to 100 MeV.

* * * * *